United States Patent [19]

Fiske et al.

[11] 4,350,435

[45] Sep. 21, 1982

[54] COPY CONTRAST AND DENSITY CONTROL

[75] Inventors: John M. Fiske, Rochester; Richard Velzen, Kodak Park, both of N.Y.

[73] Assignee: Eastman Kodak Company, Rochester, N.Y.

[21] Appl. No.: 137,149

[22] Filed: Apr. 4, 1980

[51] Int. Cl.[3] ..... G03G 15/00

[52] U.S. Cl. ..... 355/14 C; 355/14 CH; 355/14 D; 355/14 E

[58] Field of Search ..... 355/14 C, 14 E, 14 CH, 355/14 D, 14 R

[56] References Cited

U.S. PATENT DOCUMENTS

| | | | |
|---|---|---|---|
| 2,573,881 | 11/1951 | Walkup et al. . | |
| 3,914,047 | 10/1975 | Hunt, Jr. et al. | 355/14 C X |
| 4,087,171 | 5/1978 | Yano | 355/14 E X |
| 4,099,860 | 7/1978 | Connin | 355/14 C |
| 4,136,945 | 1/1979 | Stephens | 355/14 E |
| 4,162,848 | 7/1979 | Platt | 355/14 C |
| 4,239,374 | 12/1980 | Tatsumi et al. | 355/14 E |
| 4,256,401 | 3/1981 | Fujimura et al. | 355/14 C X |
| 4,279,942 | 7/1981 | Swapceinski | 427/14.1 |

FOREIGN PATENT DOCUMENTS

| | | | |
|---|---|---|---|
| 2901891 | 7/1979 | Fed. Rep. of Germany | 355/14 D |
| 54-97432 | 8/1979 | Japan | 355/14 E |
| 1559341 | 1/1980 | United Kingdom | 355/14 E |

OTHER PUBLICATIONS

Paxton Article, Electrophotographic Systems Solid Area Response Model, 22 Photographic Science and Engineering 15 (May/Jun. 1978).

*Primary Examiner*—J. V. Truhe
*Assistant Examiner*—Richard M. Moose
*Attorney, Agent, or Firm*—Raymond L. Owens

[57] ABSTRACT

For use with a copier, apparatus is provided for selecting one of a plurality of sets for adjusting the contrast and density of copies. Each set defines a particular Din/Dout response curve. The apparatus includes a stored matrix of such sets with each set having at least three different values relating to: voltage Vo applied onto the photoconductor by the primary charger, copier exposure Eo, and bias voltage $V_B$ applied to a development station electrode. The operator designates a particular set and logic and control means, adjusts Vo, Eo, and $V_B$ in accordance with the designated set values, and causes the copier to have a particular Din/Dout response curve.

8 Claims, 11 Drawing Figures

CONTRAST

| Exposure | Position (1) 1.9 | (2) 2.1 | (3) 2.4 | (4) 2.7 | (5) 3.0 | (6) 3.2 | (7) 3.4 | (8) 3.6 | (9) 3.8 |
|---|---|---|---|---|---|---|---|---|---|
| (1) .11 | -156<br>-0.49<br>130.0 | -140<br>-0.42<br>120.0 | -111<br>-0.34<br>110.0 | -78<br>-0.26<br>100.0 | -40<br>-0.18<br>90.0 | -12<br>-0.13<br>80.0 | 20<br>-0.07<br>70.0 | 56<br>-0.02<br>60.0 | 98<br>0.03<br>50.0 |
| (2) .14 | -155<br>-0.46<br>130.0 | -138<br>-0.39<br>120.0 | -109<br>-0.31<br>110.0 | -76<br>-0.23<br>100.0 | -38<br>-0.15<br>90.0 | -9<br>-0.09<br>80.0 | 23<br>-0.04<br>70.0 | 60<br>0.01<br>60.0 | 102<br>0.06<br>50.0 |
| (3) .17 | -154<br>-0.43<br>130.0 | -137<br>-0.36<br>120.0 | -107<br>-0.28<br>110.0 | -74<br>-0.19<br>100.0 | -35<br>-0.12<br>90.0 | -6<br>-0.06<br>80.0 | 26<br>-0.01<br>70.0 | 64<br>0.04<br>60.0 | 106<br>0.09<br>50.0 |
| (4) .20 | -152<br>-0.39<br>130.0 | -136<br>-0.33<br>120.0 | -106<br>-0.24<br>110.0 | -72<br>-0.16<br>100.0 | -33<br>-0.09<br>90.0 | -3<br>-0.03<br>80.0 | 30<br>0.02<br>70.0 | 68<br>0.07<br>60.0 | 110<br>0.12<br>50.0 |
| (5) .23 | -151<br>-0.36<br>130.0 | -134<br>-0.30<br>120.0 | -104<br>-0.21<br>110.0 | -69<br>-0.13<br>100.0 | -30<br>-0.05<br>90.0 | 0<br>0.00<br>80.0 | 34<br>0.05<br>70.0 | 72<br>0.10<br>60.0 | 115<br>0.16<br>50.0 |
| (6) .26 | -150<br>-0.33<br>130.0 | -132<br>-0.27<br>120.0 | -102<br>-0.18<br>110.0 | -67<br>-0.10<br>100.0 | -27<br>-0.02<br>90.0 | 3<br>0.03<br>80.0 | 38<br>0.08<br>70.0 | 77<br>0.14<br>60.0 | 120<br>0.19<br>50.0 |
| (7) .29 | -148<br>-0.38<br>130.0 | -131<br>-0.24<br>120.0 | -99<br>-0.15<br>110.0 | -64<br>-0.07<br>100.0 | -23<br>0.01<br>90.0 | 7<br>0.06<br>80.0 | 42<br>0.12<br>70.0 | 82<br>0.17<br>60.0 | 126<br>0.22<br>50.0 |
| (8) .32 | -147<br>-0.27<br>130.0 | -129<br>-0.21<br>120.0 | -97<br>-0.12<br>110.0 | -61<br>-0.04<br>100.0 | -19<br>0.04<br>90.0 | 11<br>0.10<br>80.0 | 47<br>0.15<br>70.0 | 87<br>0.20<br>60.0 | 132<br>0.25<br>50.0 |
| (9) .35 | -145<br>-0.24<br>130.0 | -127<br>-0.18<br>120.0 | -94<br>-0.09<br>110.0 | -58<br>-0.00<br>100.0 | -15<br>0.07<br>90.0 | 16<br>0.13<br>80.0 | 52<br>0.18<br>70.0 | 93<br>0.23<br>60.0 | 138<br>0.28<br>50.0 |

△ Volts ($V_O$)
△ Log E($E_O$)
Volts ($V_B$)

PRINTING CONTROLS

FIG. 11

CONTRAST

| Position | | (1) | (2) | (3) | (4) | (5) | (6) | (7) | (8) | (9) |
|---|---|---|---|---|---|---|---|---|---|---|
| | | 1.9 | 2.1 | 2.4 | 2.7 | 3.0 | 3.2 | 3.4 | 3.6 | 3.8 |
| Exposure (1) | .11 | -156 | -140 | -111 | -78 | -40 | -12 | 20 | 56 | 98 |
| | | -0.49 | -0.42 | -0.34 | -0.26 | -0.18 | -0.13 | -0.07 | -0.02 | 0.03 |
| | | 130.0 | 120.0 | 110.0 | 100.0 | 90.0 | 80.0 | 70.0 | 60.0 | 50.0 |
| (2) | .14 | -155 | -138 | -109 | -76 | -38 | -9 | 23 | 60 | 102 |
| | | -0.46 | -0.39 | -0.31 | -0.23 | -0.15 | -0.09 | -0.04 | 0.01 | 0.06 |
| | | 130.0 | 120.0 | 110.0 | 100.0 | 90.0 | 80.0 | 70.0 | 60.0 | 50.0 |
| (3) | .17 | -154 | -137 | -107 | -74 | -35 | -6 | 26 | 64 | 106 |
| | | -0.43 | -0.36 | -0.28 | -0.19 | -0.12 | -0.06 | -0.01 | 0.04 | 0.09 |
| | | 130.0 | 120.0 | 110.0 | 100.0 | 90.0 | 80.0 | 70.0 | 60.0 | 50.0 |
| (4) | .20 | -152 | -136 | -106 | -72 | -33 | -3 | 30 | 68 | 110 |
| | | -0.39 | -0.33 | -0.24 | -0.16 | -0.09 | -0.03 | 0.02 | 0.07 | 0.12 |
| | | 130.0 | 120.0 | 110.0 | 100.0 | 90.0 | 80.0 | 70.0 | 60.0 | 50.0 |
| (5) | .23 | -151 | -134 | -104 | -69 | -30 | 0 | 34 | 72 | 115 |
| | | -0.36 | -0.30 | -0.21 | -0.13 | -0.05 | 0.00 | 0.05 | 0.10 | 0.16 |
| | | 130.0 | 120.0 | 110.0 | 100.0 | 90.0 | 80.0 | 70.0 | 60.0 | 50.0 |
| (6) | .26 | -150 | -132 | -102 | -67 | -27 | 3 | 38 | 77 | 120 |
| | | -0.33 | -0.27 | -0.18 | -0.10 | -0.02 | 0.03 | 0.08 | 0.14 | 0.19 |
| | | 130.0 | 120.0 | 110.0 | 100.0 | 90.0 | 80.0 | 70.0 | 60.0 | 50.0 |
| (7) | .29 | -148 | -131 | -99 | -64 | -23 | 7 | 42 | 82 | 126 |
| | | -0.38 | -0.24 | -0.15 | -0.07 | 0.01 | 0.06 | 0.12 | 0.17 | 0.22 |
| | | 130.0 | 120.0 | 110.0 | 100.0 | 90.0 | 80.0 | 70.0 | 60.0 | 50.0 |
| (8) | .32 | -147 | -129 | -97 | -61 | -19 | 11 | 47 | 87 | 132 |
| | | -0.27 | -0.21 | -0.12 | -0.04 | 0.04 | 0.10 | 0.15 | 0.20 | 0.25 |
| | | 130.0 | 120.0 | 110.0 | 100.0 | 90.0 | 80.0 | 70.0 | 60.0 | 50.0 |
| (9) | .35 | -145 | -127 | -94 | -58 | -15 | 16 | 52 | 93 | 138 |
| | | -0.24 | -0.18 | -0.09 | -0.00 | 0.07 | 0.13 | 0.18 | 0.23 | 0.28 |
| | | 130.0 | 120.0 | 110.0 | 100.0 | 90.0 | 80.0 | 70.0 | 60.0 | 50.0 |

△ Volts ($V_0$)
△ Log E($E_0$)
Volts ($V_B$)

COPY CONTRAST AND DENSITY CONTROL

BACKGROUND OF THE INVENTION

1. Field of the Invention

The present invention relates to copiers, and more particularly, to apparatus and method for improving the contrast and density of copier copies.

2. Description of the Prior Art

It is well known that the contrast of copies can be adjusted by changing copier operation. The term contrast, as used herein, refers to the rate of change (or slope) of the output copy density Dout with respect to the input copy density Din.

In one control technique (closed-loop), the charge on a photoconductor is measured and the contrast and density of copies adjusted by varying one or more of the copier parameters. See commonly assigned U.S. Pat. No. 3,779,204, issued Dec. 18, 1973 and U.S. Pat. No. 4,087,171, issued May 2, 1978. Although this technique is useful, it is sometimes difficult to accurately measure the charge or voltage on a photoconductor.

A copier "open-loop" control technique is more frequently used. In this technique, the copier can selectively be operated at one of three sets which correspond to normal, lighten, or darken copies. Normal, lighten, or darken copies generally refers to copy density relative to input document density. For example, when a lighten copy is designated, copies are made lighter than original documents. The open-loop technique depends on the stability of all the copier parts to maintain a consistently high-quality output. Since the response of the copier parts is not always identical, let alone perfectly stable, some compromise is made during setup to allow variations to occur without causing objectionable defects in copies. For example, as developer ages, it causes changes in copy density. Consequently, in the setup for normal copy operation, exposure is usually set intentionally light (overexposed) to prevent any possible appearance of background as the developer ages. In this situation, line copy and solid area density are often not optimal. Due to manufacturing tolerances, different batches of toner and developer may have different contrasts. The term toning contrast is defined later in this specification. Suffice it here to say, since most copiers operate with fixed parameters, copy density may vary with toner or developer batches having different toning contrasts and occasionally be objectionably low or high.

With a given concentration of a particular toner in a developer, there are three copier parameters that usually are varied to change copy contrast and density. They are the voltage applied onto the photoconductor by the primary charger, the copier exposure, and the bias voltage applied to the development station. The bias voltage has the same polarity as the electrostatic image and affects toner deposition. Varying the bias voltage provides some control of copy contrast and density (especially minimum copy density).

These three are interrelated and their proper adjustment by an operator would require considerable skill and judgment on his part. Consequently, copier manufacturers have elected to provide an operator with only limited control over copy contrast and density.

DESCRIPTION OF THE DRAWINGS

FIG. 11 shows a matrix of sets associated with one of the contrast and exposure modes of operations with a digitized number corresponding to the one shown being understood to be located in the stored program control shown in FIG. 2.

SUMMARY OF THE INVENTION

Figure 1:
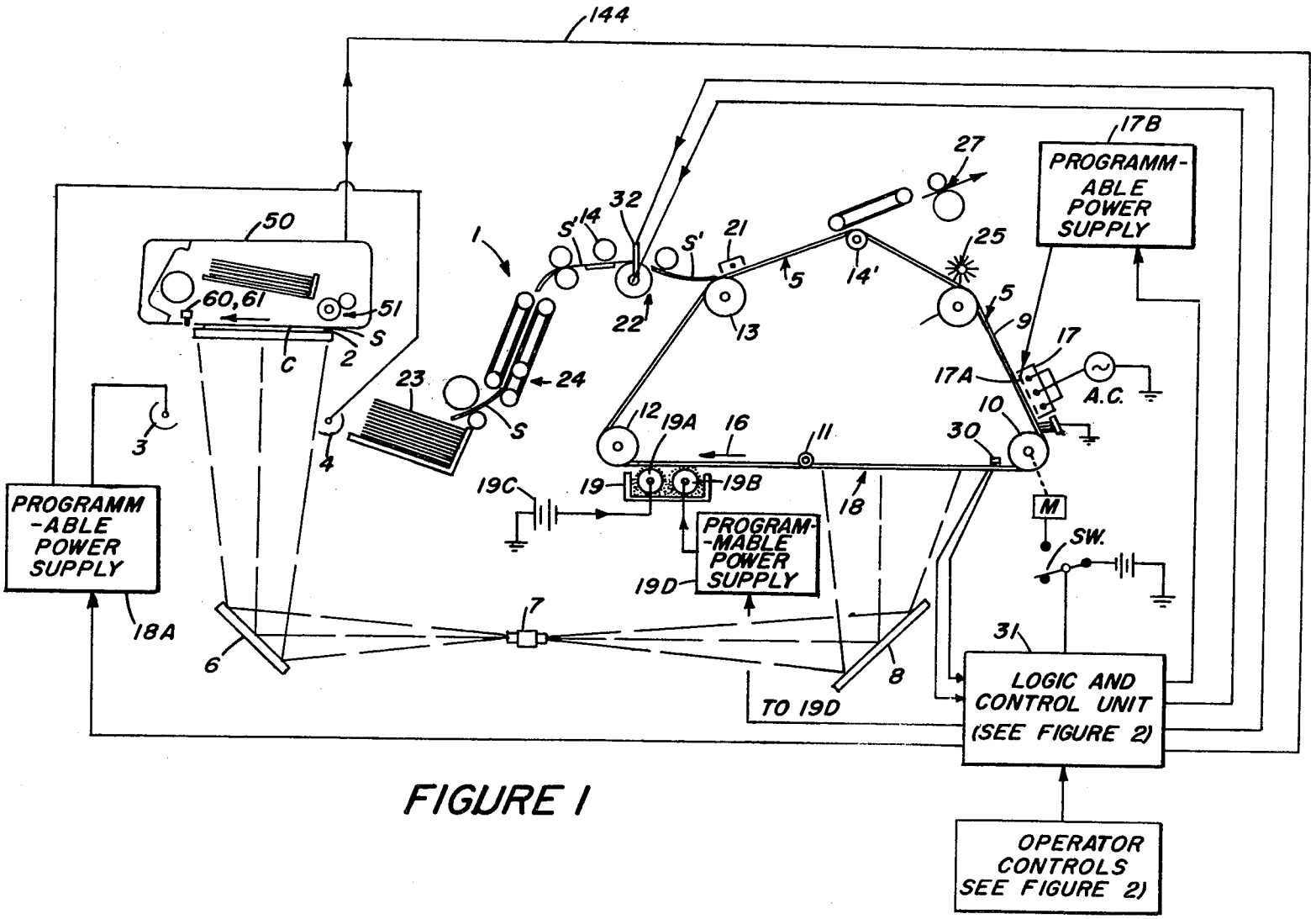
FIG. 1 is a schematic showing a side elevational view of a copier, feeder, and a logic and control unit in accordance with the invention.

In accordance with the present invention, apparatus is provided that is operable in one of two different contrast and exposure modes of operation. In the first mode, an operator can designate normal, darken, or lighten copies, whereas in the second mode he can designate one of a number of contrast and exposure settings to produce a copy having a desired contrast and density.

When operating in the second mode, an operator is provided with means for selecting one of a plurality of settings of contrast and exposure. Memory means store a plurality of sets with each set corresponding to a particular contrast and exposure setting and having three different values which relate to Vo, Eo, and $V_B$ respectively. These values of the designated set define a particulr Din/Dout response curve. After an operator designates a particular set, means responsive to the values of the designated set, change the exposure Eo produced by exposure lamps, the voltage Vo applied onto the surface of a photoconductor by a charger and the bias $V_B$ applied to an electrode of a development station to provide a copy having desired contrast and density in accordance with the Din/Dout response curve of the designated set.

The present invention is especially suitable for use with a dual-magnetic brush having transport and developer rollers. Conductive portions of these rollers act as electrodes. Separate voltage biasing of each of these rollers can be used to adjust copy contrast and density of both lines and solid areas. In dual brush magnetic brush apparatus, which may be employed in accordance with the invention, the bias voltage on the transport roller primarily affects line development and has relatively little effect on solid area development, and conversely the bias voltage on the development roller primarily affects solid area development and has relatively little effect on line development. It has been found that for most applications, a predetermined bias level of the transport roller can be empirically determined which produce lines on copies having a satisfactory contrast and density, assuming appropriate Vo and Eo are designated. Biasing the transport roller has only a minor effect on solid area response, but even if optimal Vo and Eo are designated, copy solid area contrast and density often cannot be optimized. In accordance with the invention, a particular $V_B$ is designated for each set which corresponds to the bias on the developer roller needed to improve copy solid area contrast and density.

Apparatus in accordance with the invention can accommodate a wide variety of sets, which from time to time can be adjusted, corrected, or updated to insure consistent line and solid area image development, regardless of developer age, toner, toning contrast, photoconductor age, and copier-to-copier part variations.

It is a feature of this invention to enable an operator to exercise effective control over a wide range of values to optimize copy reproduction.

DESCRIPTION OF THE PREFERRED EMBODIMENT

To assist in understanding the present invention, it will be useful to consider an electrophotographic copier having a logic and control unit, and a recirculating feeder. At the outset, it will be noted that although this invention is suitable for use with feeders, it can also be used without a feeder. Whenever the term "document" is used, it refers to a particular medium such as a sheet having an image to be copied. The term "copy" refers to the output of the copier such as a copy sheet having a fixed toner image.

Recirculating Feeder

A recirculating feeder 50 is positioned on top of an exposure platen 2 of a copier 1. The recirculating feeder may be similar to that disclosed in commonly assigned U.S. Pat. No. 4,076,408, issued Feb. 28, 1979, wherein a plurality of documents having images only on first sides of the documents can be repeatedly fed in succession from an originating document stack or set to the exposure platen 2.

The feeder 50 includes feed rollers 51 which transport a document S across the exposure platen 2. The platen 2 is constructed of transparent glass. When energized, two xenon flashlamps 3 and 4 flash illuminate the document S. For a specific disclosure of a typical exposure station, see commonly assigned U.S. Pat. No. 3,998,541, issued Dec. 31, 1976. By means of an object mirror 6, lens system 7, and an image mirror 8, an image of the illuminated document is optically stopped on discrete image areas of a moving photoconductor shown as a photoconductive web 5.

Electrophotographic Copier

The photoconductive web 5 includes a photoconductive layer with a conductive backing on a polyester support. The photoconductive layer may be formed from, for instance, a heterogeneous photoconductive composition such as disclosed in commonly assigned U.S. Pat. No. 3,615,414, issued Oct. 24, 1971. The web 5 is trained about six transport rollers 10, 11, 12, 13, 14, and 15, thereby forming an endless or continuous belt. For more specific disclosures of such a web 5, see commonly assigned U.S. Pat. Nos. 3,615,406 and 3,615,414, both issued Oct. 26, 1971. Roller 10 is coupled to a drive motor M in a conventional manner. Motor M is connected to a source of potential V when a switch SW is closed by a logic and control unit (LCU) 31. When the switch SW is closed, the roller 10 is driven by the motor M and moves the web 5 in clockwise direction as indicated by arrow 16. This movement causes successive image areas of the web 5 to sequentially pass a series of electrophotographic work stations of the copier.

For the purpose of the instant disclosure, several copier work stations are shown along the web's path. These stations will be briefly described. For more complete disclosures of them, see commonly assigned U.S. Pat. No. 3,914,047.

First, a charging station 17 is provided at which the photoconductive surface 8 of the web 5 is sensitized by applying to such surface an electrostatic charge of a predetermined voltage. The station 17 includes an A.C. charger shown as a three wire A.C. charger. The output of the charger is controlled by a grid 17A connected to a programmable power supply 17B. The supply 17B is in turn controlled by the LCU 31 to adjust the voltage Vo applied onto the surface 9 by the charger 17 in accordance with a designated set number as will be described later. For an example of digital regulation of a corona charger, see U.S. Pat. No. 4,166,690. In a specific embodiment of the invention, the grid voltage was adjusted about a nominal value of −500 volts with a 600 hertz A.C. square signal applied to the corona wires.

At exposure station 18, the inverse image of the document S is projected onto the photoconductive surface 9 of the web 5. The image dissipates the electrostatic charge at the exposed areas of the photoconductive surface 9 and forms a latent electrostatic image. A programmable power supply 18A, under the supervision of the LCU 31, controls the intensity or duration of light incident upon the web 5 to adjust the exposure Eo by the lamps 3 and 4 in accordance with a designated set number as will be described later. For a specific example of such an exposure station and programmable power supply, see commonly assigned U.S. Pat. No. 4,150,324, issued Aug. 8, 1978 to Seil.

A dual magnetic brush developing station 19 includes developer, having iron carrier particles and electroscopic toner particles with an electrostatic charge opposite to that of the latent electrostatic image. The developer is brushed over the photoconductive surface 9 of the web 5 and toner particles to adhere to the latent electrostatic image to form a visible toner particle, transferable image. The dual-magnetic brush station 19 includes two rollers, a transport roller 19A, and a developer roller 19B. As is well understood in the art, each of the rollers 19A and 19B include a conductive applicator cylinder which may be made of aluminum. In the disclosed embodiment, conductive portions, such as the drive shaft and applicator cylinder of the transport roller 19A, acts as an electrode and are electrically connected to a source of fixed D.C. potential, shown as a battery 19C. Conductive portions of development roller 19B also act as an electrode and are electrically connected to a programmable supply 19D controlled by the LCU 31 for adjusting $V_B$ in accordance with a designated set number as will be described later. For a specific disclosure of a dual magnetic brush which can be used in accordance with the invention, see commonly assigned U.S. Pat. No. 3,543,720. See commonly assigned U.S. Pat. Nos. 3,575,505, 3,654,893, and 3,674,532 for disclosures of biasing development station rollers. See also Canadian Patent No. 979,299.

The copier 1 also includes a transfer station shown as a corona charger 21 at which the toner image on web 5 is transferred to a copy sheet S'; and a cleaning station 25, at which the photoconductive surface 9 of the web 5 is cleaned of any residual toner particles remaining thereon after the electroscopic images have been transferred and is discharged of any residual electrostatic charge remaining thereon.

After transfer of the unfixed electroscopic images to a copy sheet S', such sheet is transported to fuser 27 where the image is fixed to it.

To coordinate operation of the various work stations 17, 18, 19, 21, and 25 with movement of the image areas on the web 5 past these stations, the web has a plurality of perforations along one of its edges. These perforations generally are spaced equidistantly along the edge of the web member 16. For example, the web member 5 may be divided into six image areas by F perforations; and each image area may be subdivided into 51 sections by C perforations. The relationship of the F and C perforations to the image areas is disclosed in detail in commonly assigned U.S. Pat. No. 3,914,047. At a fixed location along the path of web movement, there is provided suitable means 30 for sensing F and C web perforations. This sensing produces input signals into the LCU 31 which has a digital computer, preferably a microprocessor. The microprocessor has a stored program responsive to the input signals for sequentially actuating then de-actuating the work statons as well as for controlling the operation of many other machine functions as disclosed in U.S. Pat. No. 3,914,047.

Logic and Control Unit (LCU)

Programming of a number of commercially available microprocessors such as in INTEL model 8080 or model 8085 microprocessor (which along with others can be used in accordance with the invention), is a conventional skill well understood in the art. The following disclosure is written to enable a programmer having ordinary skill in the art to produce an appropriate contrast and exposure control program for the microprocessor. The particular details of any such program would, of course, depend on the architecture of the designated microprocessor.

Figure 2:
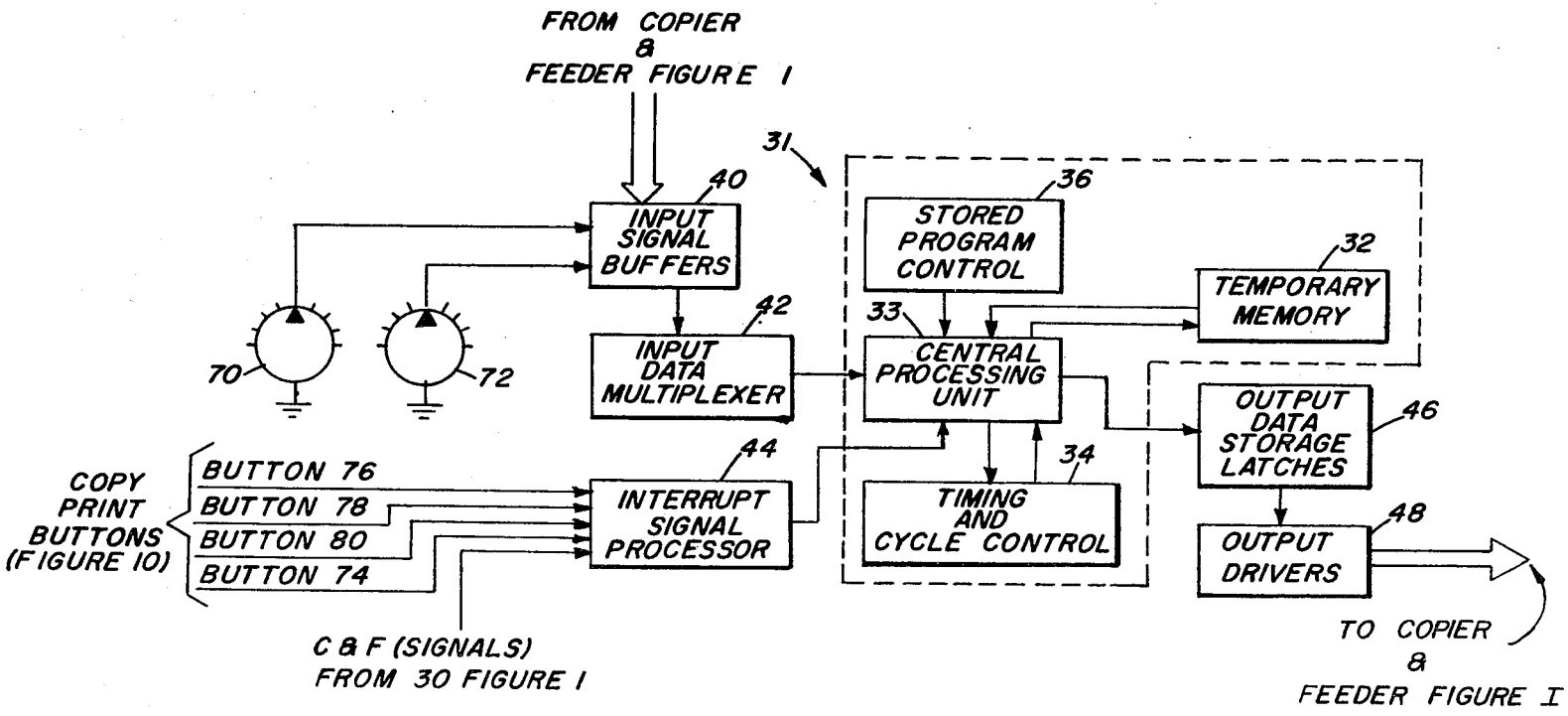
FIG. 2 is a block diagram of the logic and control unit shown in FIG. 1.

Turning now to FIG. 2, a block diagram of a typical logic and control unit (LCU) 31 is shown which interfaces with the copier 1 and the feeder 50. Leads 144 from feeder 50 provide inputs to and receive outputs from LCU 31 to synchronize the operation of the feeder. For a more detailed disclosure of the disclosure of the feeder 50, see commonly assigned U.S. Pat. No. 3,978,787. The LCU 31 consists of temporary data storage memory 32, central processing unit 33, timing and cycle control unit 34, and stored program control 36. Data input and output is performed sequentially under program control. Input data are applied either through input signal buffer 40 to a multiplexer 42 or to interrupt signal processor 44. The input signals are derived from various switches, sensors, and analog-to-digital converters. The output data and control signals are applied to storage latches 46 which provide inputs to suitable output drivers 48, directly coupled to leads. These leads are connected to the work stations and to a copy sheet registration feeding mechanism 22. As shown, interrupt signals are provided by copy buttons 76, 78, 80, and 74 shown in detail in FIG. 10, and information representing a particular set of the matrix shown in FIG. 11 is designated by exposure knob 70 and contrast knob 72 which provide inputs to buffers 40 via their respective analog/digital converters (not shown).

Returning now to the microprocessor, the contrast and exposure control program includes the matrix shown in FIG. 11, which is in a digitized format, located in stored program control 36, provided by one or more conventional Read Only Memories (ROM). The ROM contains operational programs in the form of binary words corresponding to instructions and values. These programs are permanently stored in the ROM and cannot be altered by the computer operation.

The temporary storage memory 32 may be conveniently provided by a conventional, Read/Write memory or Random Access Memory (RAM).

As shown in FIG. 1, a copy sheet S′ is fed from a supply 23 to continuously driven rollers 14, (only one of which is shown) which then urge the sheet against a rotating registration finger 32 of a copy sheet registration mechanism 22. When the finger rotates free of the sheet, the driving action of the rollers 14 and sheet buckle release cause the sheet to move forward onto the photoconductor in alignment with a toner image at the transfer station 21.

Contrast and Exposure Control

For a detailed explanation of the theory of copier contrast and exposure control, reference may be made to the following article: Paxton, Electrophotographic Systems Solid Area Response Model, 22 Photographic Science and Engineering 150 (May/June 1978). It is believed helpful to use the theory in explaining the present invention. One way to explain copier contrast and exposure control theory is to examine the four-quadrant plots or graphs shown in FIGS. 3–9, which show how designated effect the Din/Dout response curve (Quadrant I). Din refers to original document reflective density, and Dout refers to copy reflective density. To facilitate understanding these graphs, the following terms are defined:

$V_B$=Developer roller bias.

Vo=Initial voltage (relative to ground) on the photoconductor just after the charger 17.

$V_F$=Photoconductor voltage (relative to ground) just after exposure by flash lamps.

E=Actual exposure of photoconductor. (Light produced by the flash lamps (Eo) is reflected off of a portion of a document having a particular density Din onto the photoconductor and causes a particular level of exposure E of the photoconductor.

Figure 3:
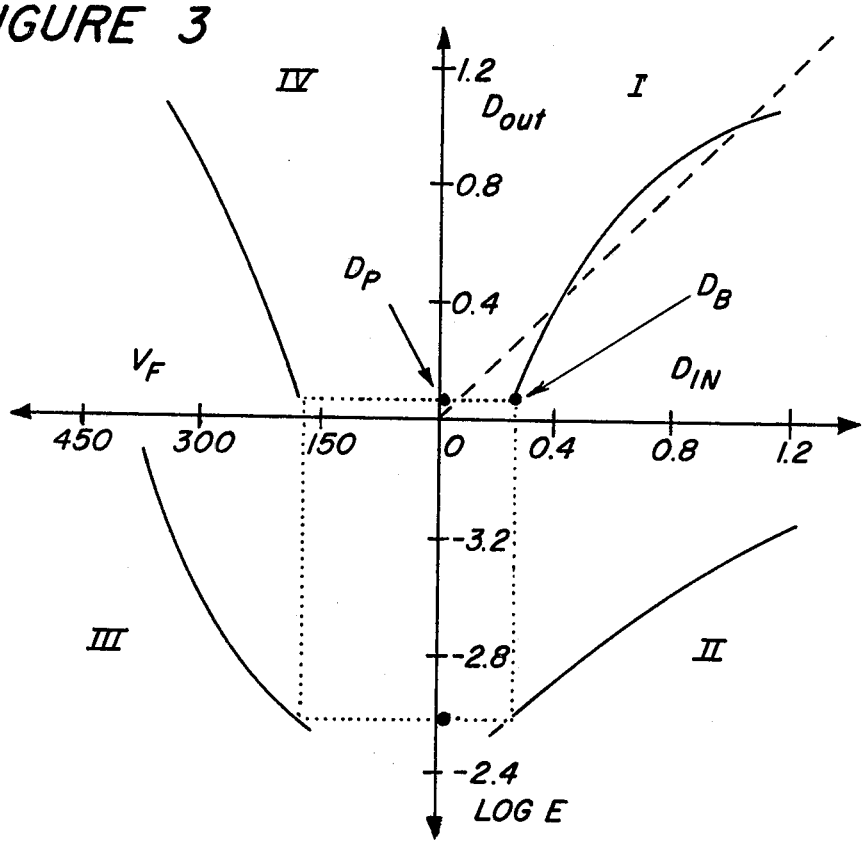
FIGS. 3–9 set forth graphs which illustrate typical Din/Dout response curves for the copier of FIG. 1.

In accordance with this invention, contrast and exposure control is achieved by the choice of Vo, Eo, and $V_B$. In FIG. 3, we will assume that these have already been determined for a copier, and it has a particular Din/Dout response curve. At its lower end, the Din/Dout response curve terminates at a point, called the breakpoint $D_B$. When the input document density Din is at or below a density which corresponds to the breakpoint $D_B$, no toning takes place and the output copy density is the reflective of plain paper Dp. In FIG. 3, the $D_B$ point corresponds to a Din of approximately 0.3. In selecting the appropriate Din/Dout response curve, it is important to designate the appropriate $D_B$ point. For example, if a copier is adjusted to have the response curve of FIG. 3, and if a document contained information with a Din of 0.2, then this information would be lost. On the other hand, if the lowest information in the document had a Din of 0.4, then a copy may contain objectionable background. Thus, it is desirable to set the $D_B$ of a response curve, at a position which corresponds to the lowest Din level of information on a document. The present invention permits an operator to designate (contrast control) a desired Din/Dout response curve and to position such curve in Quadrant I so it has a desired $D_B$ breakpoint (exposure control).

The effects on the Din/Dout response curve by changing Eo, Vo, and $V_B$ will now be described.

Exposure (Eo)

Changes in exposure Eo (Quadrant II) (FIG. 4) changes the Din/Dout response curve and there is a breakpoint ($D_B$) shift in the Din/Dout response curve. Increasing exposure will translate the curve to the right and the $D_B$ point moves to correspond to an increased Din value.

Voltage (Vo)

Changes to Vo (FIG. 5) causes both a breakpoint $D_B$ and contrast shift (Din/Dout curve translation and rotation). Increasing Vo lowers the breakpoint and increases copy contrast.

Figure 6:
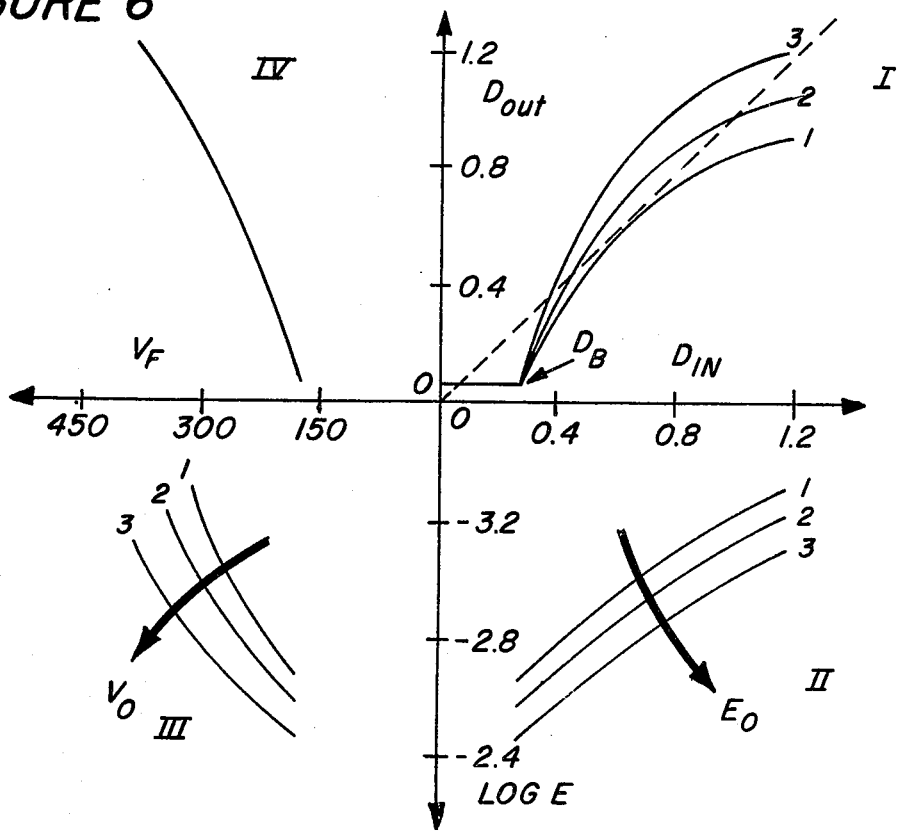
Figure 7:
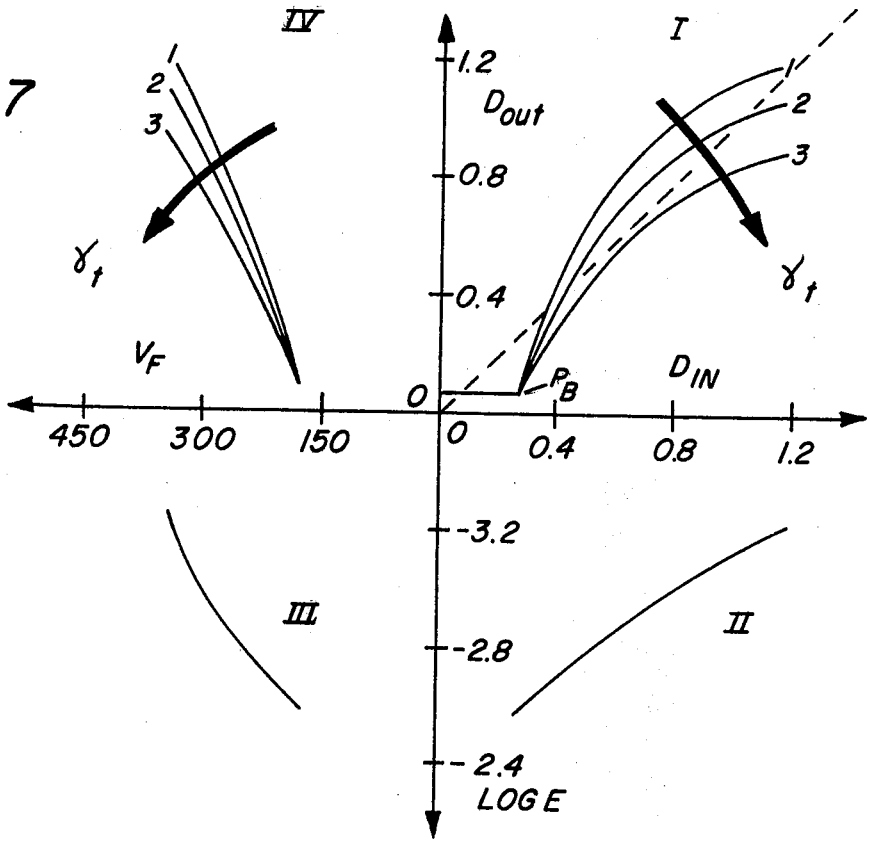
Figure 8:
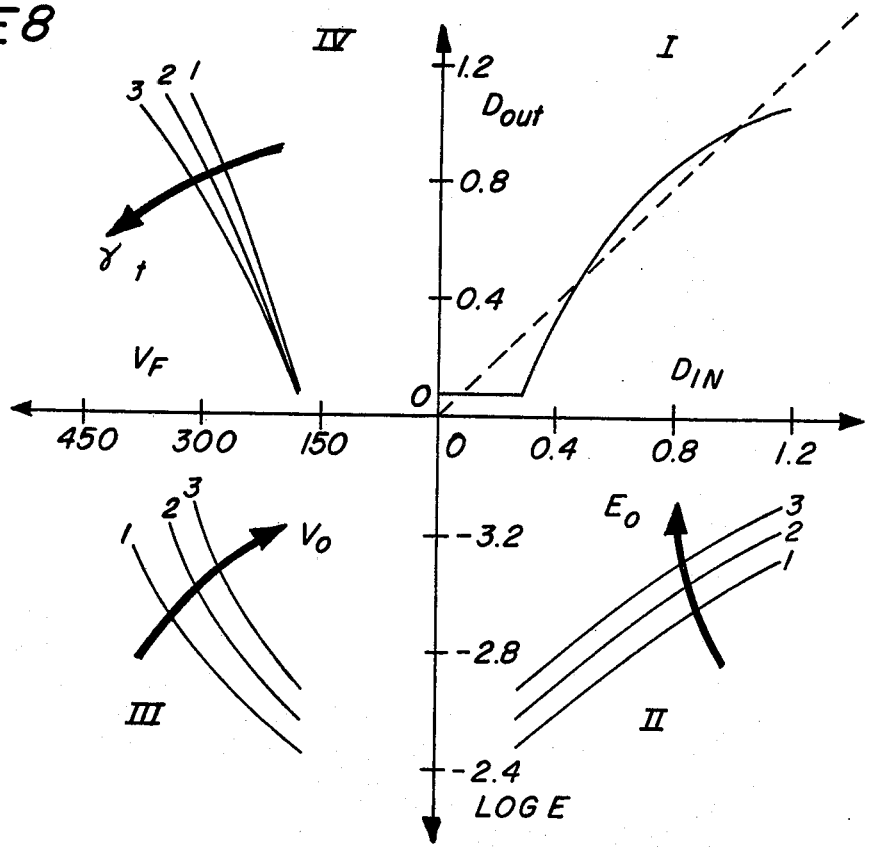
Figure 9:
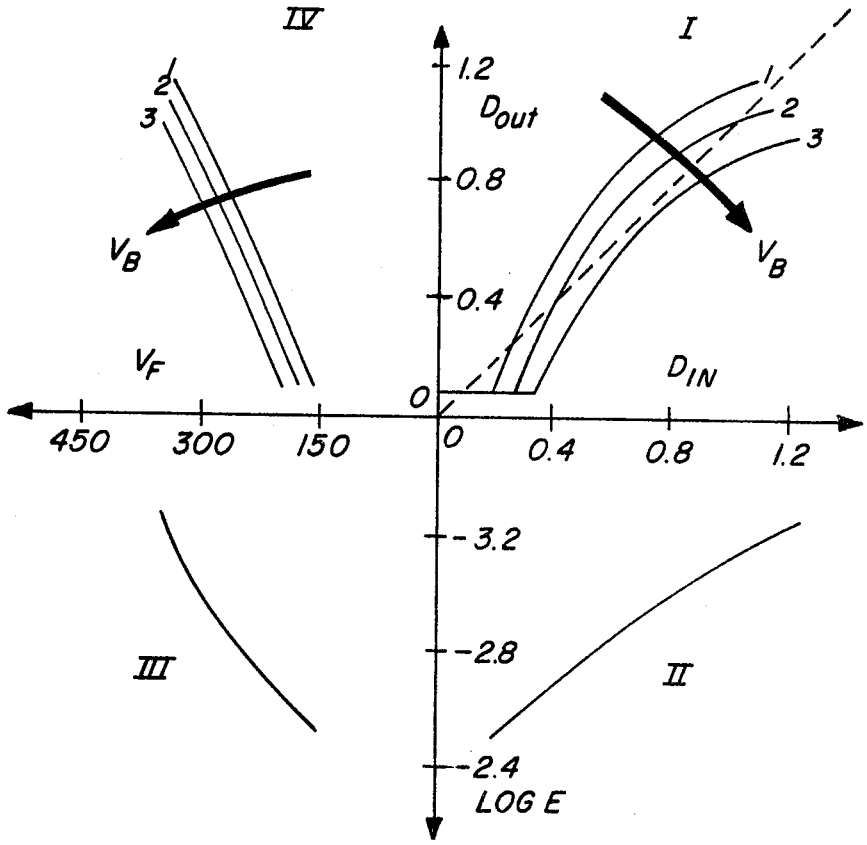

The proper combination of Vo and Eo can result in the conditions shown in FIG. 6 where the breakpoint remains fixed, but the copy contrast increases with increasing Eo and Vo. Simultaneous changes to Eo and Vo constitute the basis for contrast control.

Contrast control apparatus, in accordance with the invention, performs two functions. It provides convenient means for maintaining a predetermined Din/Dout relationship (process control) and provides the operator with specific controls over contrast and density to compensate for a range of input document contrasts and densities.

Toning contrast $\gamma t$ is the constant of proportionality between toner mass deposited on a photoconductor and photoconductor voltage $V_F$. Viewed differently, it is the slope of the Dout/$V_F$ curve, (FIG. 7), and is a function of changing environmental conditions, toner age, and toner concentration in the developer mixture. As the toner age or life increases, the toning contrast decreases. Changes in toning contrast can be offset by a corresponding change in Vo and Eo. Thus, by increasing Vo and Eo (FIG. 8) as toning contrast decreases, a stable Din/Dout response can be maintained.

Bias (VB)

Up to this point, we have shown how Vo and Eo affect the Din/Dout response curve. Changes in these affect copy contrast on both lines and solids. The third process control in accordance with the invention is development roller bias voltage $V_B$. It has been determined that a predetermined bias level of the transport roller 19A can produce lines.on copies having satisfactory contrast and density assuming an appropriate combination of Vo and Eo is designated. In an embodiment of the invention, the transport roller bias was fixed at −200 V. The development roller bias $V_B$ primarily affected the breakpoint of the solid area response and its relative position in the Din/Dout curve, Quadrant I. Dual biasing makes it possible to have independent control of the line and solid area breakpoints. Although it has been found satisfactory to use a fixed transport roller bias, it will be understood that line copy response can be further adjusted by making the transport roller bias adjustable.

Operator Controls

Figure 4:
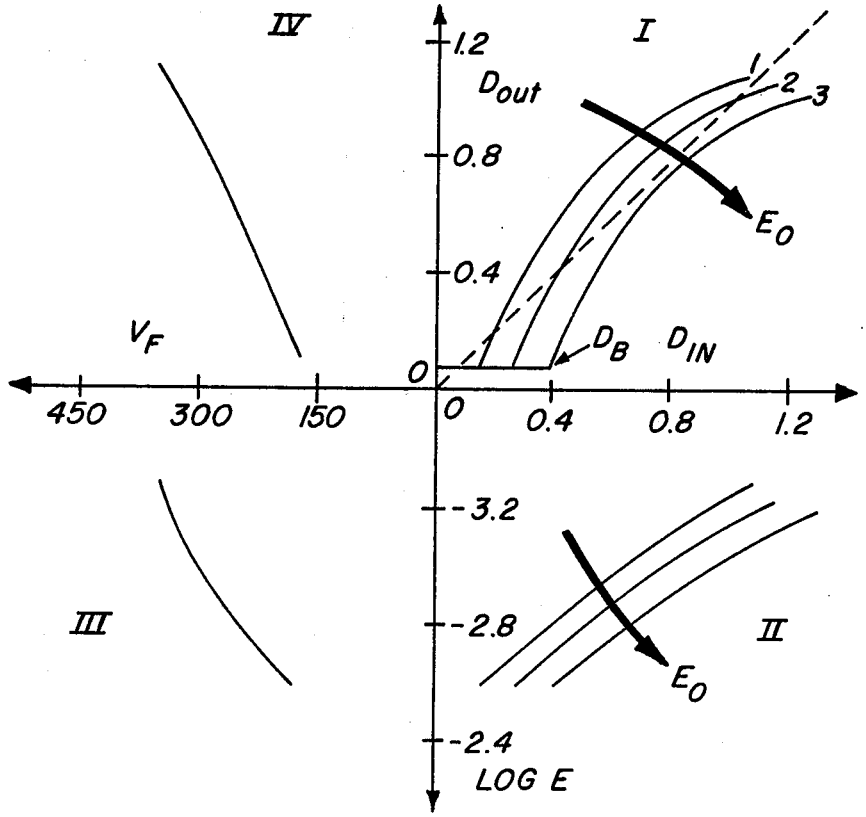
Figure 5:
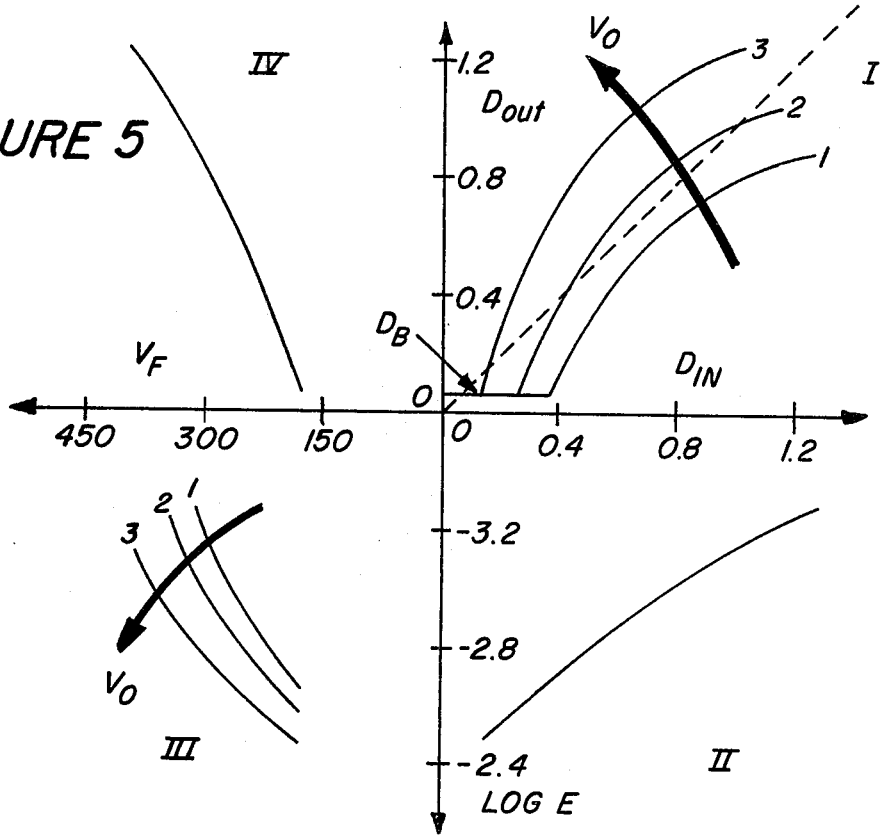
Figure 10:
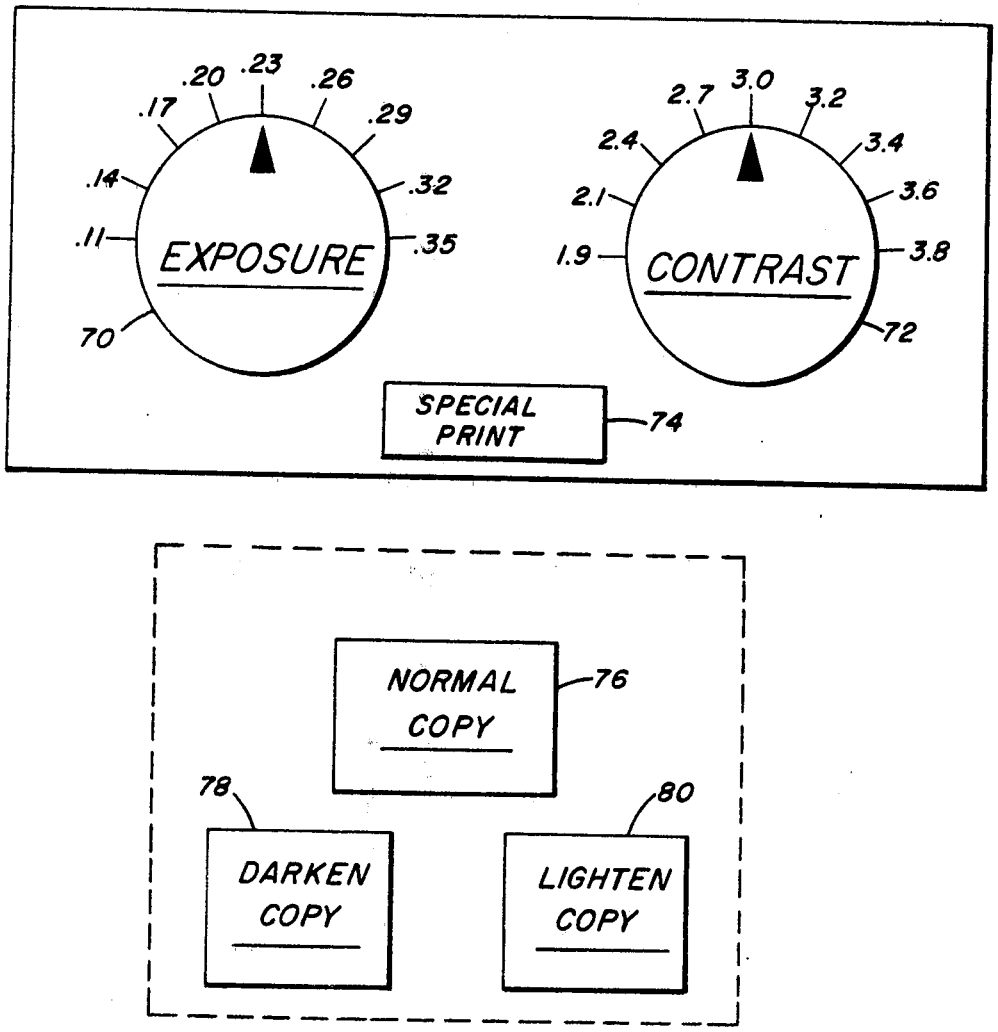
FIG. 10 shows copier controls for operating the apparatus of FIG. 1 in first and second contrast and exposure modes.

The operator controls consist of the two rotary knobs, exposure knob 70 and contrast knob 72, and the special print copy button 74 (see FIG. 10). These controls are in additin to the normal, darken and lighten copy buttons 76, 78, and 80 usually found on copiers. Both knobs have nine discrete positions. The first knob 70 functions as an exposure control and translates the breakpoint of the Din/Dout curve (FIG. 4).

When the knob 72 is turned, any one of nine different copy contrasts can be designated. The breakpoint $D_B$ can be changed depending upon the position of the exposure knob 70. The position of the knob 72 defines the shape of a particular Din/Dout response curve, and the position of knob 70 defines its location in Quadrant I and positions the $D_B$ point.

To obtain a copy representative of the conditions designated by the exposure and contrast knobs, the special print copy button 74 must be depressed. If one of the normal, darken or lighten copy buttons is depressed, the computer ignores positions of the knobs 70 and 72, and a Din/Dout response curve corresponding to the normal, darken or lighten copy button designated will be produced. By means of this arrangement, a casual operator can choose to make copies by the conventional normal, darken or lighten copy button selection method.

The two control knobs 70 and 72 (nine positions each) correspond to eighty-one sets which in turn correspond to different Din/Dout response curves. A normal copy can also be obtained by depressing the special print copy button 74 when the exposure knob 70 is in position 5 and the contrast knob 72 is in position 6. Darken and lighten copies also have their own sets number, but they are not part of the eighty-one sets. As shown in FIG. 11, there is a 9×9 matrix, which will be understood to be located in an ROM of stored program control 36. The matrix is an array of quantities arranged in nine rows and nine columns. There are eighty-one positions in the matrix. At the intersection of each column and row there is a set having three set values which from top to bottom represent Vo, Eo, and $V_B$ respectively. These values provide adjustments for copier Vo, Eo, and $V_B$. The particular values shown in FIG. 11 are for a specific copier which used a specific type of photoconductor and are given for illustrative purposes only. The eighty-one sets can accommodate a wide range of adjustments so that a copy having a desired contrast and density can be produced regardless of line and solid area contrast and density, of input documents, toning contrast, and toner age or other conditions of the copier.

The matrix values that are actually stored in memory are in a digital format and correspond to values of specific parameters. The microprocessor converts these values into adjustments of corresponding programmable power supplies. An operator, by selecting a particular row (knob 70) and column (knob 72), designates a particular one of the 81 sets with its values. The contrast knob designates the column of the matrix, and the exposure knob designates the row. At the intersection of the column and row is the desired set. For a specific example using the values shown in FIG. 11, at matrix position (5,6), the Vo and Eo values are both 0. There is no adjustment of the power supply 17B, and Vo ideally should be at a predetermined voltage level of say 476 volts. Also, Eo is at the normal exposure level without adjustment. $V_B$ is at 80 volts. At matrix position (2,8), the number 60 corresponds to an increase of 60 volts to provide a Vo of 336 volts, the number of 0.01 indicates Eo is increased by 0.01 log E and the number 60 indicates $V_B$ is 60 volts. As illustrated in FIG. 11, for any given exposure (row), changing the column position changes Vo, Eo, and $V_B$. However, for any column, a change in the exposure knob (row) changes Vo and Eo while $V_B$ remains constant.

In operation, let us assume an operator believes an output copy having contrast which corresponds to position 8 of exposure knob 70 would be desirable. In this example, let us further assume he sets exposure knob at position 7. Position 7 defined a particular $D_B$ point. He now makes a copy, and let us assume the copy contrast is indeed at the desired level, but the copy has some objectionable background. He now would move the $D_B$ point by selecting exposure position 6. The new Din/Dout response curve is substantially identical to the previous one, except that the curve has been shifted to the left in Quadrant I, and a new $D_B$ point is defined. The operator would then make another copy to see if the background was eliminated. Assuming it was, then he would produce the desired number of copies. Thus, when an operator makes a change in contrast or exposure, the logic and control will automatically designate the appropriate Vo, $V_B$, and Eo values.

The sets shown in FIG. 11 represent nominal sets for a copier which could be manufactured in quantity. Thus, the Vo and Eo values are for a "standard copier". Due to manufacturing variances in corresponding copier parts and toner, these values may not produce a copy having the desired contrast and density.

To overcome this problem, a larger size of matrix array sets for Vo, Eo, and $V_B$ can be stored in ROM. Since, as disclosed, the array size needed is 9×9, then the larger array size, which includes the 9×9 array, may for example be 15×15. If, in such a scheme, the desired copy result at the normal copy position (nominally designated to be at 5,6) is achieved by finding its actual set location within the larger array (say 15×15) that achieves the closest Do and contrast for a normal copy. Thus, the normal copy position may, for example, be at set (5,7). The contiguous 9×9 array set positions in the larger matrix array are then used until a recalibration is performed.

The invention has been described with particular reference to a preferred embodiment thereof, but it will be understood that variations and modifications can be effected within the spirit and scope of the invention.

What is claimed is:

1. Copy solid area, contrast and density adjusting apparatus for use in a copier having a chargeable photoconductor, adjustable charging means for varying the voltage Vo applied onto the photoconductor, an adjustable exposure station for varying the copier exposure Eo, and a development station having at least one electrode and adjustable bias means for applying an adjustable bias voltage $V_B$ to said electrode for establishing a bias voltage between the photoconductor and said development station to affect copy solid area density; said apparatus comprising:

(a) memory means having stored therein a matrix of sets of representations of interrelated electrical values, with each such set having values which correspond to specific levels of Vo, Eo, and $V_B$ that define a particular solid area copier Din/Dout response curve with a predetermined breakpoint;

(b) means for addressing said matrix to designate a particular set; and (c) logic and control means responsive to the values of said designated set to adjust said adjustable charging means, said adjustable bias means and said adjustable exposure station to produce copies in accordance with the Din/Dout response curve defined by such designated set values.

2. Copy solid area, contrast and density adjusting apparatus for use in a copier having a chargeable photoconductor, adjustable charging means for varying the voltage Vo, applied onto the photoconductor, an adjustable exposure station for varying the copier exposure Eo, and a development station having at least one electrode and adjustable bias means for applying an adjustable bias voltage $V_B$ to said electrode for establishing a bias voltage between the photoconductor and said development station to affect copy solid area density; said apparatus comprising:

(a) memory means having stored therein a matrix of sets of representations of interrelated electrical values, with such matrix having a plurality of columns and plurality of rows wherein at the intersection of each column and row there is a set of values which correspond to specific levels of Vo, Eo, and $V_B$ that define a particular solid area copier Din/Dout response curve with a predetermined breakpoint;

(b) means for addressing a particular column and a particular row of such matrix to designate the set located at their intersection; and (c) logic and control means responsive to the values of said designated set to adjust said exposure station, said charging means, and said adjustable bias means respectively to thereby optimize copy solid area contrast and density.

3. Copy solid area, contrast and density adjusting apparatus for use in a copier having a chargeable photoconductor, adjustable charging means for varying the voltage Vo, applied onto the photoconductor, an adjustable exposure station for varying the copier exposure Eo, and a development station having at least one electrode and adjustable bias means for applying an adjustable bias voltage $V_B$ to said electrode for establishing a bias voltage between the photoconductor and said development station to affect copy solid area density; said apparatus comprising:

(a) a stored matrix of sets of representations of interrelated electrical values, with such matrix having a plurality of columns and plurality of rows wherein at the intersection of each column and row there is a set having values which correspond to specific levels of Vo, Eo, and $V_B$ that define a particular copier solid area Din/Dout responsive curve having a predetermined breakpoint, and wherein the Din/Dout response curve corresponding to a set in any row position of a particular matrix column is substantially identical in shape but has a different breakpoint;

(b) means for addressing a particular column and a particular row of such matrix to designate the set located at their intersection; and (c) logic and control means responsive to the values of said designated set to adjust said exposure station, said charging means, and said adjustable bias means respectively to thereby optimize copy solid area contrast and density.

4. The invention as set forth in claim 3 wherein the Din/Dout responsive curve for each row position of a matrix column is substantially identical in shape but has a different breakpoint.

5. A method of controlling the contrast and density of copies produced by a copier having a magnetic brush with a developer roller, comprising the steps of:

(a) storing in a memory of matrix array of sets of representations of interrelated electrical values, with each set having values which respectively correspond to specific levels of the voltage Vo applied onto the copier photoconductor, the copier exposure Eo, and the bias $V_B$ applied to the developer roller to establish a voltage between the development roller and the photoconductor respectively;

(b) addressing the matrix to designate a particular set; and (c) adjusting the voltage Vo, exposure Eo, and the bias voltage $V_B$ in accordance with the values of the designated set to effect a change in the solid area and contrast density of copies.

6. The invention as set forth in claim 5, including the step of choosing a smaller array within the matrix array from which sets can be designated.

7. Copy, line and solid area, contrast and density adjusting apparatus for use in a copier having a chargeable photoconductor, adjustable charging means for varying the voltage Vo applied onto the copier photoconductor, an adjustable exposure station for varying the exposure Eo, and a dual magnetic brush development station with developer and transport rollers, said apparatus comprising:

(a) adjustable bias means for applying an adjustable bias voltage $V_B$ to said developer roller for establishing a voltage between such roller and the photoconductor to affect copy solid area density;

(b) means for applying a predetermined bias voltage to said transport roller for establishing a voltage between such transport roller and the photoconductor to affect line copy density;

(c) memory means having stored therein a matrix of sets of representations of interrelated electrical values, with such matrix having a plurality of columns and plurality of rows wherein at the intersection of each column and row there is a set having values which correspond to specific levels of Vo, Eo, and $V_B$ that define a particular copier Din/Dout response solid area, curve with a predetermined breakpoint;

(d) means for addressing a particular column and a particular row of such matrix to designate the set located at their intersection; and (e) logic and control means responsive to the values of said designated set to adjust said exposure station, said charging means, and said adjustable bias means respectively to thereby optimize copy solid area contrast and density.

8. A method of controlling the line and solid area, contrast and density of copies produced by a copier having a dual magnetic brush with developer and transport rollers, comprising the steps of:

(a) biasing said transport roller with a predetermined voltage for establishing a voltage between such roller and the photoconductor to affect copy line contrast and density;

(b) biasing said developer roller with an adjustable bias voltage $V_B$ for establishing a voltage between such roller and the photoconductor to affect copy solid area density;

(c) storing in a memory a matrix of sets of representations of interrelated electrical values, with each set having values respectively corresponding to specific levels of the voltage Vo applied onto the copier photoconductor, the copier exposure Eo, and the bias $V_B$ applied to the developer roller to establish a voltage between the development roller and the photoconductor respectively;

(d) addressing the matrix to designate a particular set of values; and (e) adjusting the voltage Vo, exposure Eo, and the bias voltage $V_B$ in accordance with the values of said designated set to effect a change in the line and solid area, contrast and density of copies.

* * * * *